US009779673B2

(12) United States Patent
Matsui et al.

(10) Patent No.: US 9,779,673 B2
(45) Date of Patent: Oct. 3, 2017

(54) DISPLAY AND BACKLIGHT CONTROLLER AND DISPLAY SYSTEM USING THE SAME

(71) Applicant: InnoLux Corporation, Miao-Li County (TW)

(72) Inventors: Yoshikazu Matsui, Miao-Li County (TW); Masahiro Yoshiga, Miao-Li County (TW)

(73) Assignee: INNOLUX CORPORATION, Taiwan (CN)

( * ) Notice: Subject to any disclaimer, the term of this patent is extended or adjusted under 35 U.S.C. 154(b) by 127 days.

(21) Appl. No.: 14/822,986

(22) Filed: Aug. 11, 2015

(65) Prior Publication Data

US 2017/0047023 A1 Feb. 16, 2017

(51) Int. Cl.
*G09G 3/36* (2006.01)

(52) U.S. Cl.
CPC ..... *G09G 3/36* (2013.01)

(58) Field of Classification Search
CPC combination set(s) only.
See application file for complete search history.

(56) References Cited

U.S. PATENT DOCUMENTS

2005/0259064 A1* 11/2005 Sugino ..... G09G 3/342 345/102
2008/0158212 A1* 7/2008 Maruyama ..... G09G 3/2025 345/208
2008/0284719 A1* 11/2008 Yoshida ..... G02F 1/136277 345/102
2012/0162289 A1* 6/2012 Oniki ..... G09G 3/342 345/690

* cited by examiner

*Primary Examiner* — Van Chow
(74) *Attorney, Agent, or Firm* — Bacon & Thomas, PLLC

(57) ABSTRACT

A display system is provided with a low frequency driving mode. A low frequency display interval of the display system is divided into a charge period and a suspend period in the low frequency driving mode. A backlight brightness of the display system is changed in the suspend period.

15 Claims, 10 Drawing Sheets

DISPLAY AND BACKLIGHT CONTROLLER AND DISPLAY SYSTEM USING THE SAME

BACKGROUND OF THE INVENTION

1. Field of the Invention

The present invention relates to the technical field of display panels and, more particularly, to a display and backlight controller and a display system using the same.

2. Description of Related Art

Liquid crystal display (LCD) devices are widely used as space-saving type displays and, in recent years, have begun to be used in electronic devices. However, due to the limited battery power of the electronic devices, a low power LCD is anxiously demanded to avoid charging the battery frequently.

When a still image is displayed on the screen, it basically doesn't need to refresh the still image so often. Therefore, it is possible to drive the panel in a low frequency driving mode and this leads to the realization of low power LCD. However, in case of the low frequency driving mode, it is likely to observe an unsatisfactory flickering phenomenon. FIG. 1 is a schematic view illustrating one of the factors which would result in the flickering phenomenon. As shown in FIG. 1, in the low frequency driving mode, the refresh rate is about 1 Hz; i.e., the display system updates a still image in every second. The flexoelectric effect becomes an issue if the refresh rate is low, as indicated in circle "A" of FIG. 1. A large change of brightness results in the flickering phenomenon.

To prevent the flickering phenomenon, LCDs are usually driven with a high frequency (about 60 Hz) as shown in FIG. 2. FIG. 2 is a schematic view illustrating the brightness in a normal driving mode in the prior art. As shown in FIG. 2, in the normal driving mode, 60 frames are displayed per second. That is, the time for displaying a frame is about 16.67 milliseconds (ms). In the normal driving mode, the brightness change is not so obvious due to the high driving frequency. However, in consideration of displaying a still image, it wastes much power for refreshing 60 frames per second.

In addition to the flexoelectric effect, the brightness of the TFT panel may also be changed due to TFT cut-off current leakage. In this case, the brightness will be gradually changed during a suspend period. FIG. 3 is a schematic view illustrating the brightness change in low frequency driving mode of TFT LCD in the prior art. As shown in FIG. 3, the brightness is expected to be maintained with a constant value in the suspend period. However, due to the TFT cut-off current leakage, the brightness is gradually decreased in actual application. Especially, in the end of the suspend period, the brightness is decreased dramatically. At the next charge period, the capacitors corresponding to the pixels of the TFT panel are charged again, and then the brightness of the TFT panel is abruptly increased, resulting in the undesired flickering phenomenon.

Therefore, it is desirable to provide an improved display panel system to mitigate and/or obviate the aforementioned problems.

SUMMARY OF SOME EMBODIMENTS OF THE INVENTION

A display and backlight controller and an active matrix display system using the same is described, which can eliminate the flicker phenomenon of an LCD panel in a low frequency driving mode, so as to reduce the power consumption in a portable device and thus prolong the usage lifetime.

According to one embodiment of the present disclosure, there is provided a display system having a low frequency driving mode, in which a display interval in one frame is divided into a charge period and a suspend period, and a backlight brightness of the display system is changed in the suspend period.

According to another embodiment of the present disclosure, there is provided a display system comprising a display panel, a backlight module, and a display and backlight controller. The display panel includes a plurality of scan lines, a plurality of source lines intersecting the scan lines, and a plurality of pixels arranged at intersections of the scan lines and the source lines. The backlight module is coupled to the display panel and projecting light to the pixels of the display panel. The display and backlight controller receives an image data and connects to the display panel and the backlight module for providing a low frequency driving mode. In the low frequency driving mode, a display interval in one frame is divided into a charge period and a suspend period, and the backlight brightness is changed in the suspend period.

Other embodiments of the present disclosure will become more apparent from the following detailed description when taken in conjunction with the accompanying drawings.

DETAILED DESCRIPTION OF THE PREFERRED EMBODIMENT

Figure 4:
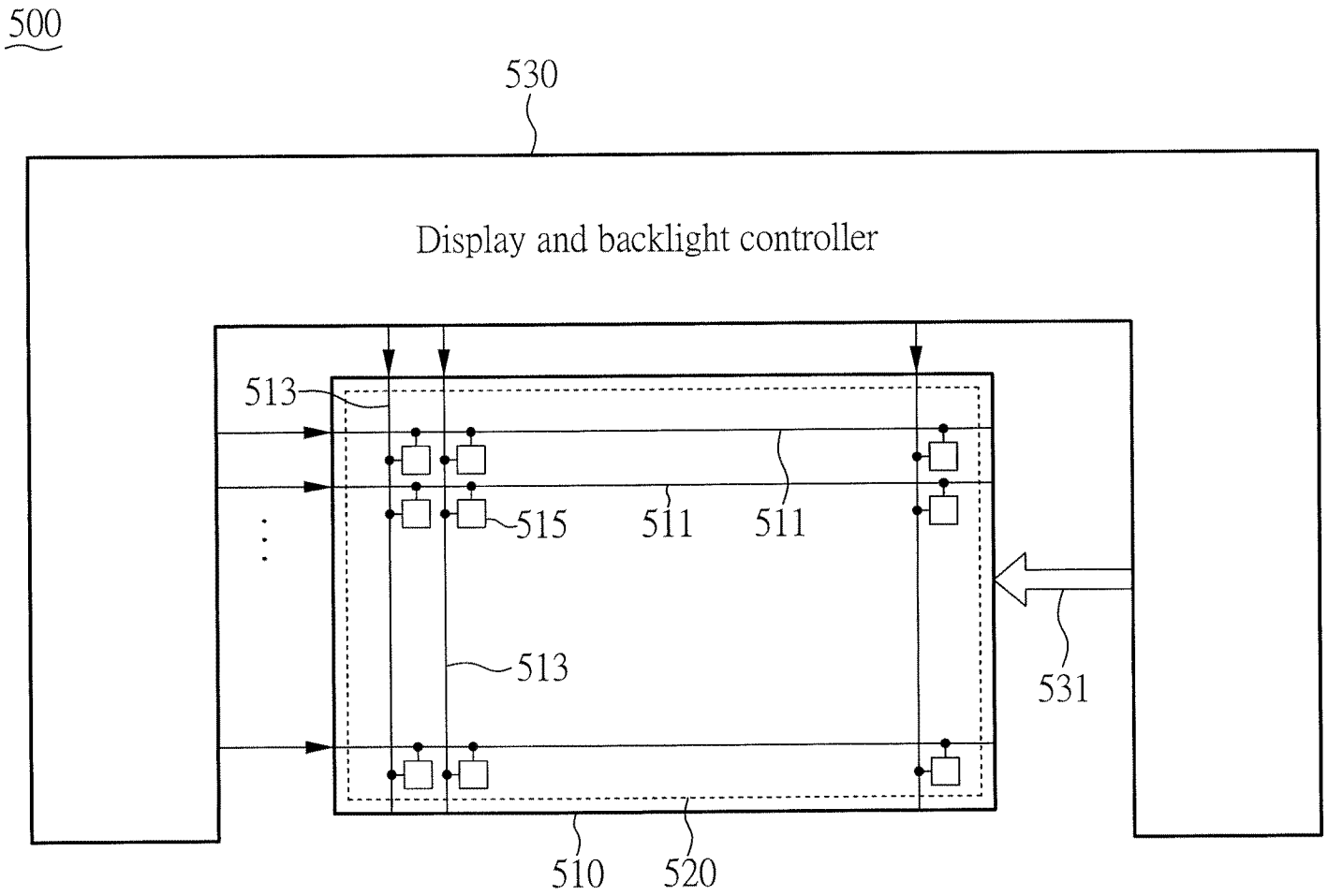
FIG. 4 is a block diagram of a display system in accordance with an embodiment of the present disclosure.

FIG. 4 is a block diagram of a display system 500 in accordance with an embodiment of the present disclosure. The display system 500 includes a display panel 510, a backlight module 520, and a display and backlight controller 530. The display panel 510 can be an active matrix display panel or a passive matrix display panel.

The display panel 510 has a plurality of scan lines 511, a plurality of source lines 513, and a plurality of pixels 515, wherein the plurality of source lines 513 insulatively intersect the scan lines 511, and each of the plurality of pixels 515 is arranged at an intersection of the scan lines 511 and the source lines 513. The display panel 510 receives a panel driving signal to drive the plurality of pixels 515 for displaying an image.

The display panel 510 has a normal driving mode and a low frequency driving mode.

The backlight module 520 is coupled to the display panel 510 for projecting light to the plurality of pixels 515 according to a backlight drive signal 531. In the present disclosure, the brightness of the light projecting from the backlight module 520 is defined as the backlight brightness.

The display and backlight controller 530 is connected to the display panel 510 and the backlight module 520 for providing a low frequency driving mode or a normal driving mode.

The FIGS. 1, 2, 3, 5, 6 are schematic views illustrating the brightness of the display system 500 perceived by an observer in front of the display system 500.

Figure 1:
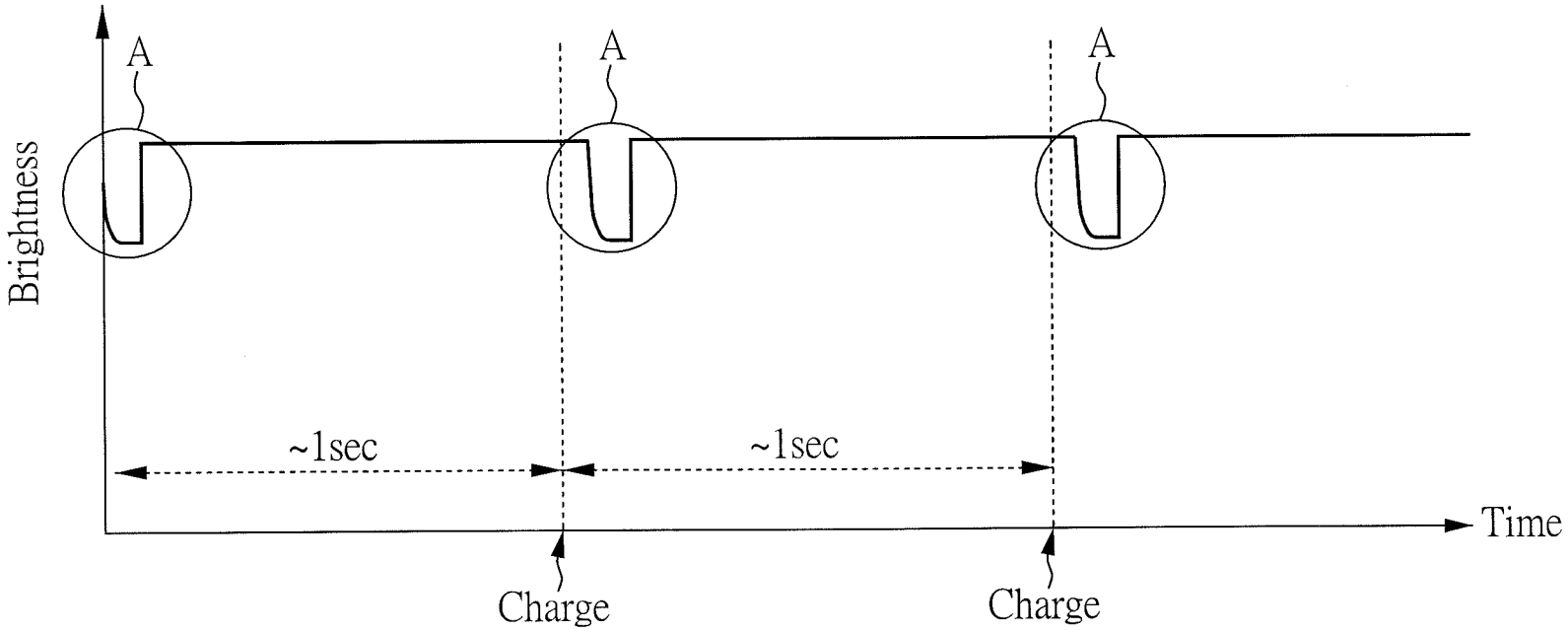
FIG. 1 (PRIOR ART)
FIG. 1 is a schematic view illustrating the flickering phenomenon in the prior art.
Figure 2:
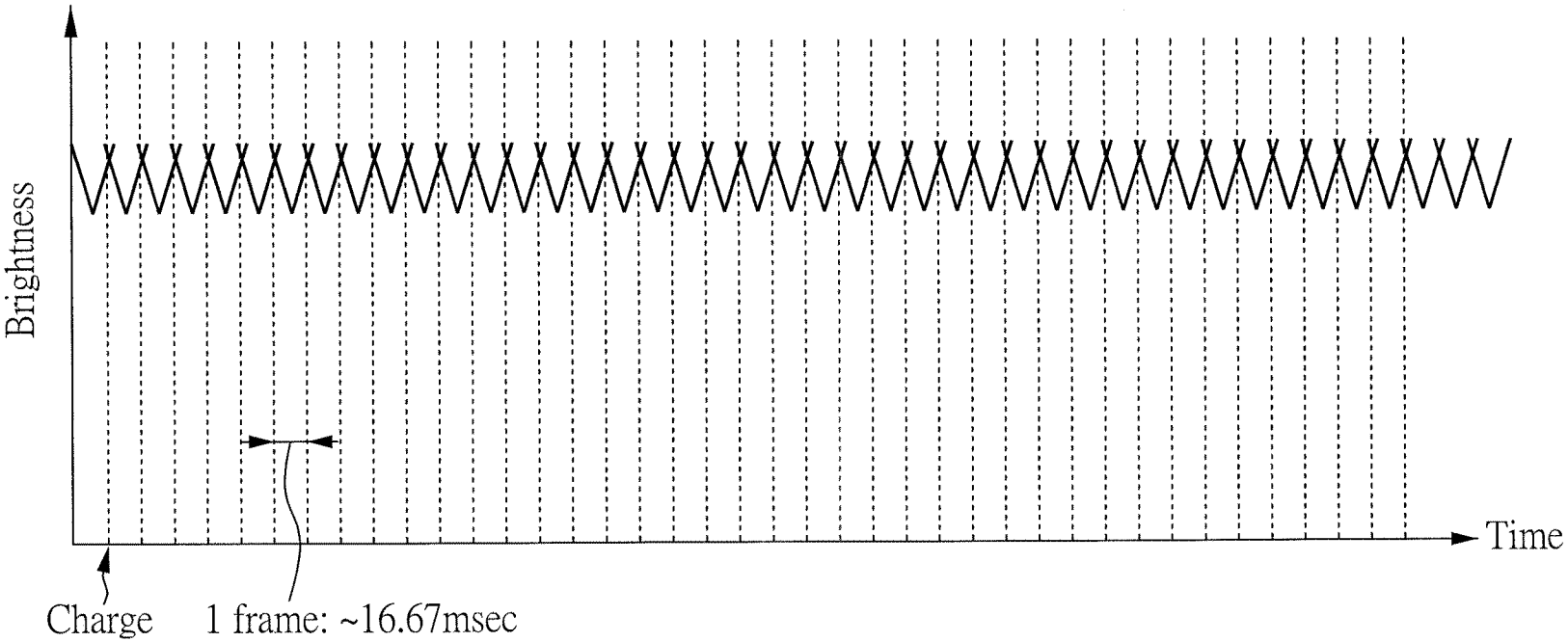
FIG. 2 (PRIOR ART)
FIG. 2 is a schematic view illustrating the brightness in a normal driving mode of TFT LCD in the prior art.
Figure 3:
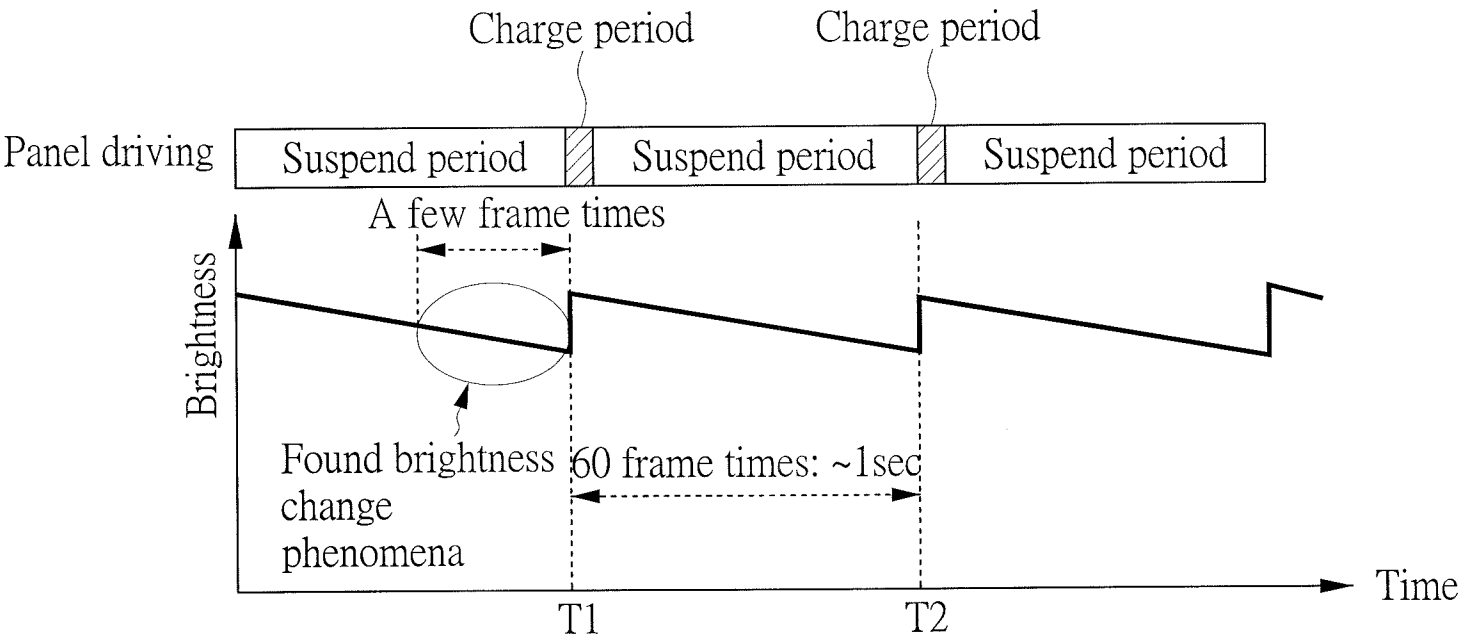
FIG. 3 (PRIOR ART)
FIG. 3 is a schematic view illustrating the brightness change in a low frequency driving mode of TFT LCD in the prior art.

The normal driving mode is shown in FIG. 2. As shown in FIG. 2, in the normal driving mode, a TFT panel displays 60 frames per second. In other words, the time interval for displaying a frame is equal to 16.67 milliseconds (ms). The present disclosure defines that one frame time is equal to 16.67 milliseconds (ms). In the low frequency driving mode, the TFT panel displays one LFD (low frequency driving) frame per second. In other words, the low frequency display interval for displaying a LFD frame is equal to 1 second (1 s). In other embodiments, the low frequency display interval can be 2 seconds, 0.5 second, and so on.

Figure 5:
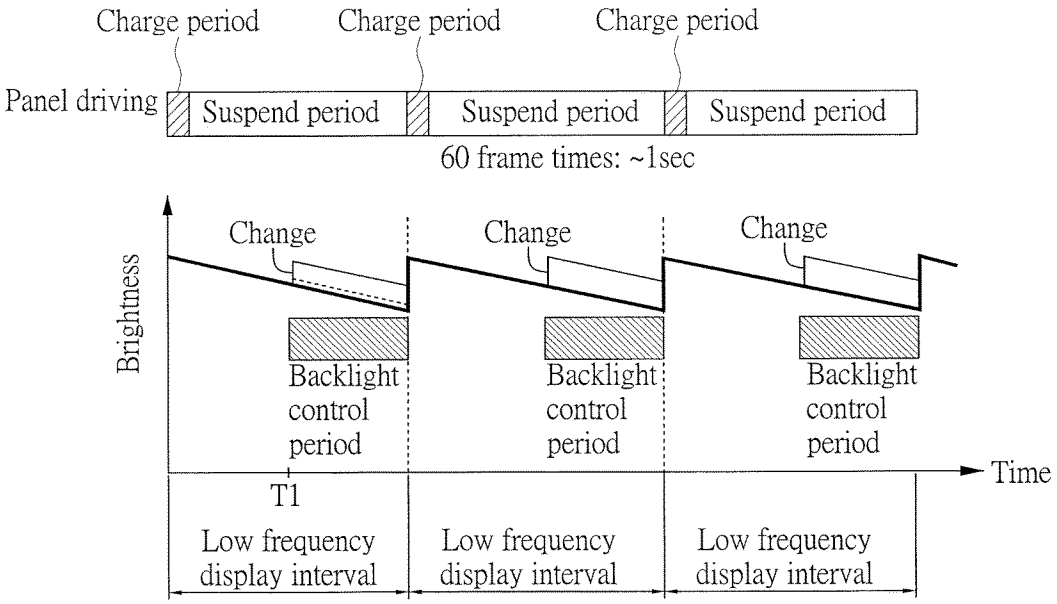
FIG. 5 is a schematic view illustrating the brightness change in the low frequency driving mode in accordance with an embodiment of the present disclosure.
Figure 6:
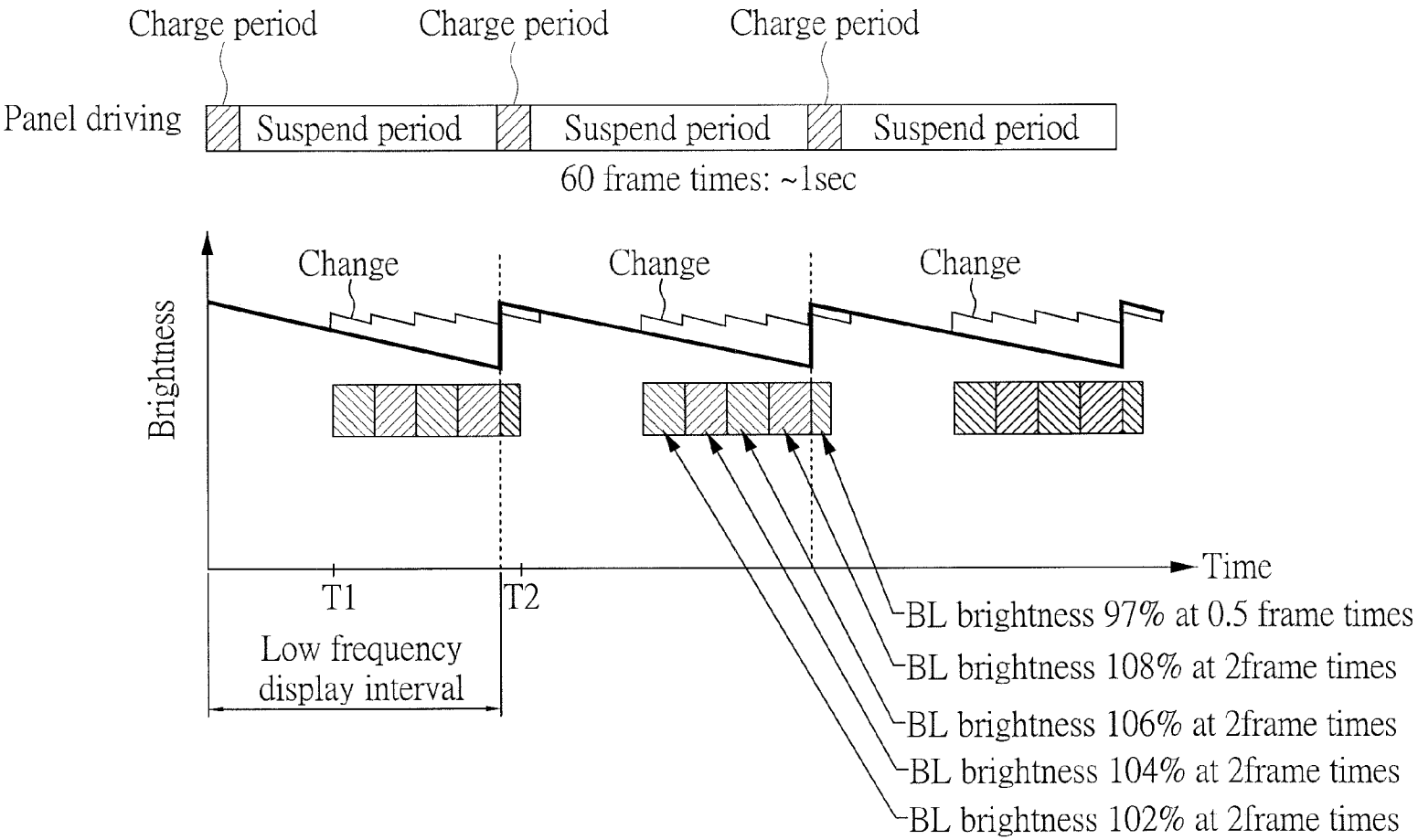
FIG. 6 is a schematic view illustrating the brightness change in the low frequency driving mode in accordance with another embodiment of the present disclosure.

FIG. 5 is a schematic view illustrating brightness change in the low frequency driving mode according to an embodiment of the present disclosure. FIG. 6 is a schematic view illustrating brightness change in the low frequency driving mode according to another embodiment of the present invention. In the low frequency driving mode, the display interval, also called as "low frequency display interval", in one frame is divided into a charge period and a suspend period. As shown in FIG. 5 and FIG. 6, the backlight brightness of the display system 500 is changed in the suspend period.

Moreover, the backlight brightness starts to be changed from a predetermined value to other values at a first specific time (T1) in a second half of the suspend period in the low frequency display interval. The first specific time (T1) can be located in any time point in the second half of the suspend period. In FIG. 5, the backlight brightness finishes to be changed at the end of low frequency display interval, which means the backlight brightness is changed from the other values to the predetermined value. In FIG. 6, the backlight brightness finishes to be changed at a second specific time (T2) in a first half of a charge period in a successive frame.

As shown in FIG. 5, the start point of backlight brightness is at the second half of the suspend period, while as shown in FIG. 6 the end point of backlight brightness is at the first half of the charge period. The period of backlight brightness being changed is equal to or longer than a half of the charge period and equal to or shorter than a half of the suspend period. The period of backlight brightness being changed is called "backlight control period." The change of the backlight brightness is employed to increase or decrease the backlight brightness. In other words, the backlight brightness is changed from a first brightness to a second brightness.

If the display panel 510 is a normally black mode display panel, the backlight brightness is increasing to compensate the loss of the brightness owing to TFT cut-off current leakage. In this case, the second brightness is greater than the first brightness. If the display panel 510 is a normally white mode display panel, the backlight brightness is decreasing to compensate the gain of the brightness owing to TFT cut-off current leakage. In this case, the second brightness is smaller than the first brightness. Besides, as shown in FIG. 5, the backlight brightness is changed once in the suspend period. As shown in FIG. 6, the backlight brightness is changed at least two times in the suspend period.

Figure 7:
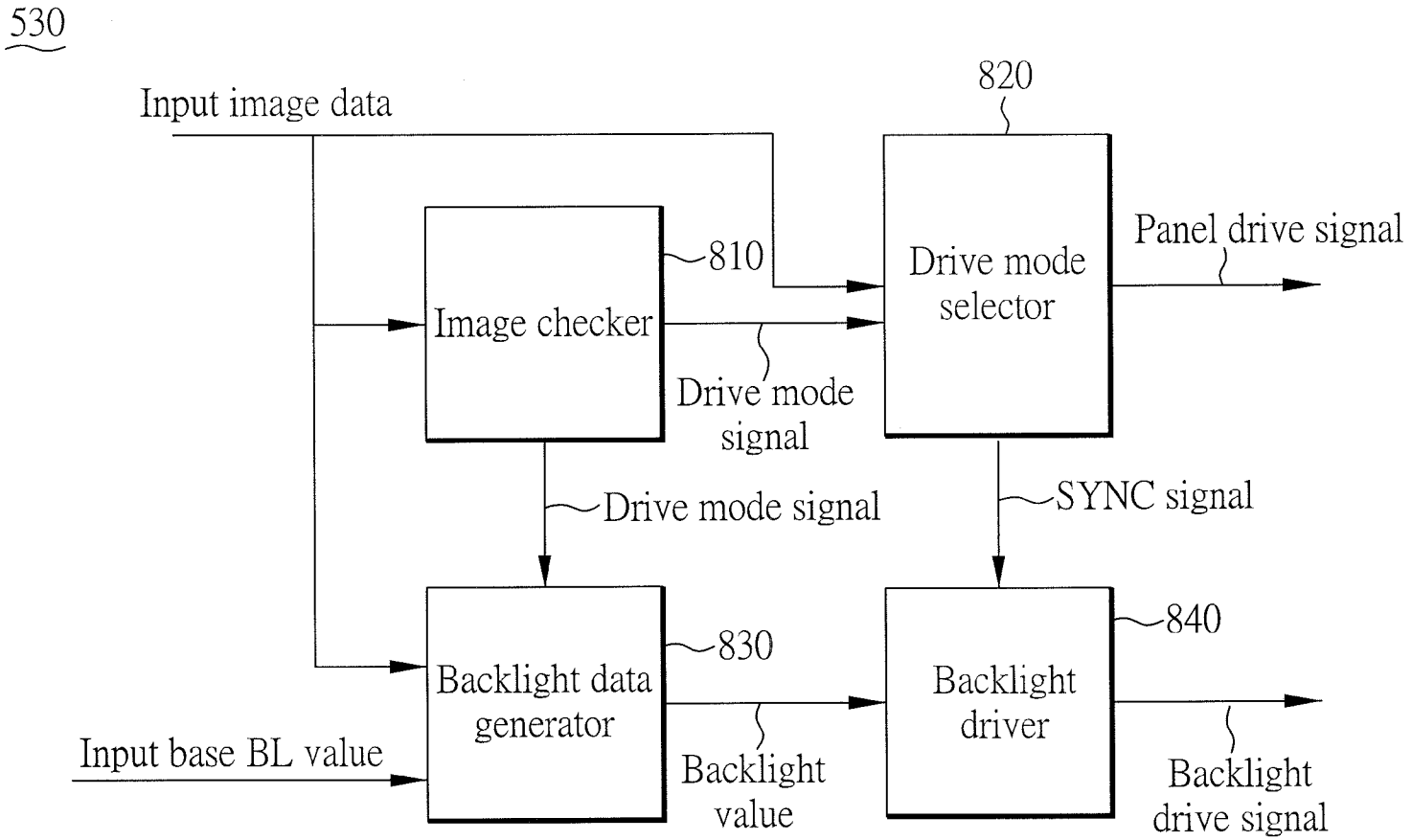
FIG. 7 is a block diagram of the display and backlight controller in accordance with an embodiment of the present disclosure.

FIG. 7 is a block diagram of the display and backlight controller 530 in accordance with an embodiment of the present disclosure. The display and backlight controller 530 includes an image checker 810, a drive mode selector 820, a backlight data generator 830, and a backlight driver 840.

The image checker 810 receives an input image data to determine whether the input image data is corresponding to a moving image or a still image, and outputs a corresponding drive mode signal to the drive mode selector 820. If the input image data is corresponding to a moving image, the drive mode signal is configured to be "1"; otherwise, if the input image data is corresponding to a still image, the drive mode signal is configured to be "0".

The drive mode selector 820 is connected to the image checker 810 for receiving the input image data and the drive mode signal. The drive mode selector 820 outputs a panel drive signal to the display panel 510 based on the drive mode signal. If the drive mode signal is "1" which indicates that the input image data is corresponding to a moving image, the drive mode selector 820 outputs the panel drive signal with the normal driving mode. Otherwise, if the drive mode signal is "0" which indicates that the input image data is corresponding to a still image, and the drive mode selector 820 outputs the panel drive signal with the low frequency driving mode. In other embodiments, the drive mode signal can be other format rather than "1" or "0".

The backlight data generator 830 is connected to the image checker 810 and receives the input image data, an input base backlight value, and the drive mode signal. The backlight data generator 830 outputs a backlight value according to the drive mode signal, the input image data and the input base backlight value.

The backlight driver 840 is connected to the drive mode selector 820 and the backlight data generator 830 for receiving a synchronous signal (SYNC signal) outputted from the drive mode selector 820 and the backlight value outputted from the backlight data generator 830, so as to generate the backlight drive signal. The backlight driver 840 may use the pulse-width-modulation or the current amplification technology to generate the backlight drive signal according to the backlight value.

Figure 8:
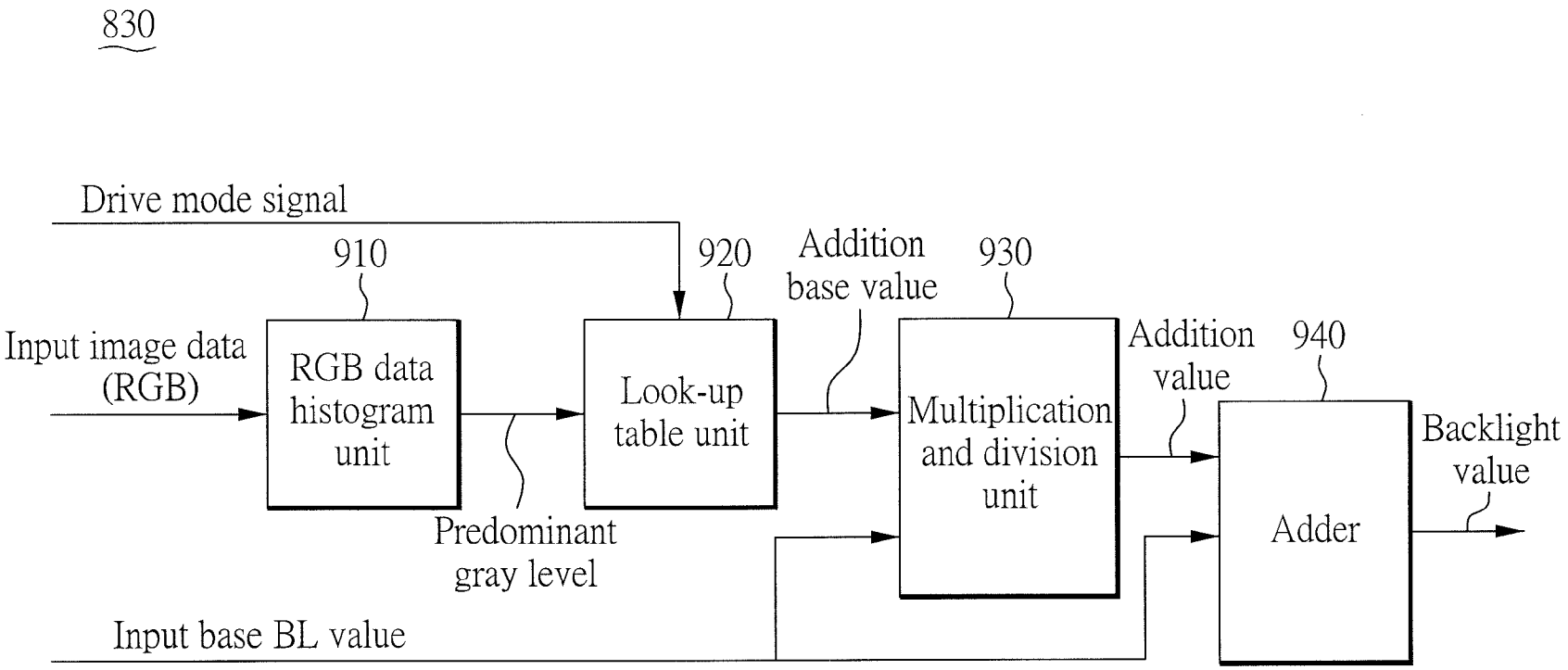
FIG. 8 is a block diagram of the backlight data generator in accordance with an embodiment of the present disclosure.

FIG. 8 is a block diagram of the backlight data generator 830 in accordance with an embodiment of the present disclosure. The backlight data generator 830 includes an RGB data histogram unit 910, a look-up table unit 920, a multiplication and division unit 930, and an adder 940.

The RGB data histogram unit 910 receives the input image data and selects a predominant gray level of the input image data.

The look-up table unit 920 is connected to the RGB data histogram unit 910 and the image checker 810 for generating an addition base value according to the predominant gray level and the drive mode signal. The addition base value can be a positive, negative, or a zero value. If the drive mode signal is "1" which indicates that the input image data is corresponding to a moving image, the addition base value is zero.

The multiplication and division unit 930 is connected to the look-up table unit 920 for generating an addition value according to the addition base value and an input base backlight value.

The adder 940 is connected to the multiplication and division unit 930 for adding the addition value and the input base backlight value to generate the backlight value. The backlight value is expressed as:

$$bl_value=(add_base_value \times input_base_bl_value/pre_bl_data)+input_base_bl_value,$$

where bl value represents the backlight value, add_base_value represents the addition base value, input_base_bl_value represents the input base backlight value which is corresponding to the input image data, and the pre_bl_data represents a pre-determined brightness backlight data. Preferably, the pre-determined brightness backlight data (pre_bl_data) is a 100% brightness backlight data.

With reference to FIG. 6 again, starting from the charge period to the first specific time (T1), the backlight driver 840 drives the backlight module 520 by outputting the backlight drive signal with 100% backlight (BL) brightness. In this disclosure, 100% backlight (BL) brightness means a predetermined backlight brightness not yet changed.

But starting from the first specific time (T1), the backlight driver 840 drives the backlight module 520 by outputting the backlight drive signal with 102% backlight (BL) brightness. After 2 frame times, the backlight driver 840 drives the backlight module 520 by outputting the backlight drive signal with 104% BL brightness. The backlight driver 840 drives the backlight module 520 by outputting the backlight drive signal with 106% BL brightness and 108% BL brightness in the successive 2 frame times. At the beginning of the charge period, the backlight driver 840 drives the backlight module 520 by outputting the backlight drive signal with 97% BL brightness and lasts about 0.5 frame time. In the present disclosure, backlight change ratio is defined by a ratio of the changed backlight brightness to the 100% backlight (BL) brightness. In other embodiments, the backlight brightness is changed by the backlight drive signal to have an 0.8-1.2 backlight change ratio. Further, in other embodiments, the changed backlight brightness lasts 1 frame time, or multiple frame times.

As shown in FIG. 6, in a second half of the suspend period during the low frequency display interval, the brightness is gradually decreased owing to TFT cut-off current leakage. The backlight driver 840 thus increases the backlight drive signal to compensate the loss of the brightness owing to TFT cut-off current leakage. In a first half of the charge period during the low frequency display interval, the capacitors corresponding to the pixels of the TFT panel are charged again. The backlight driver 840 decreases the backlight drive signal so as to keep the brightness in constant during the low frequency display interval.

Figure 9:
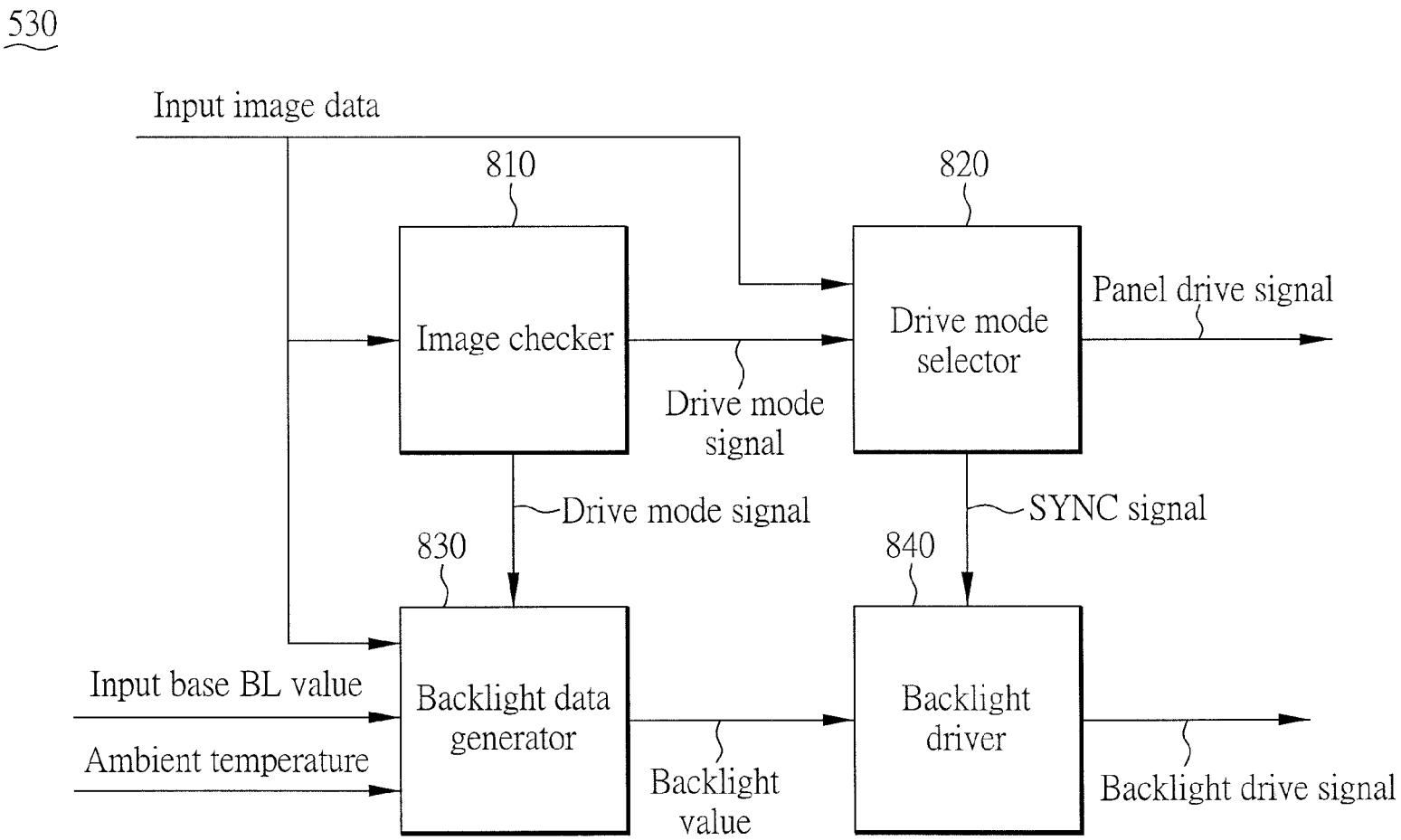
FIG. 9 is a block diagram of the display and backlight controller in accordance with another embodiment of the present disclosure.

FIG. 9 is a block diagram of the display and backlight controller 530 in accordance with another embodiment of the present disclosure. FIG. 9 is similar to FIG. 7 except for the backlight data generator 830. The backlight data generator 830 outputs a backlight value according to the drive mode signal, the input image data, the input base backlight value, and the ambient temperature.

Figure 10:
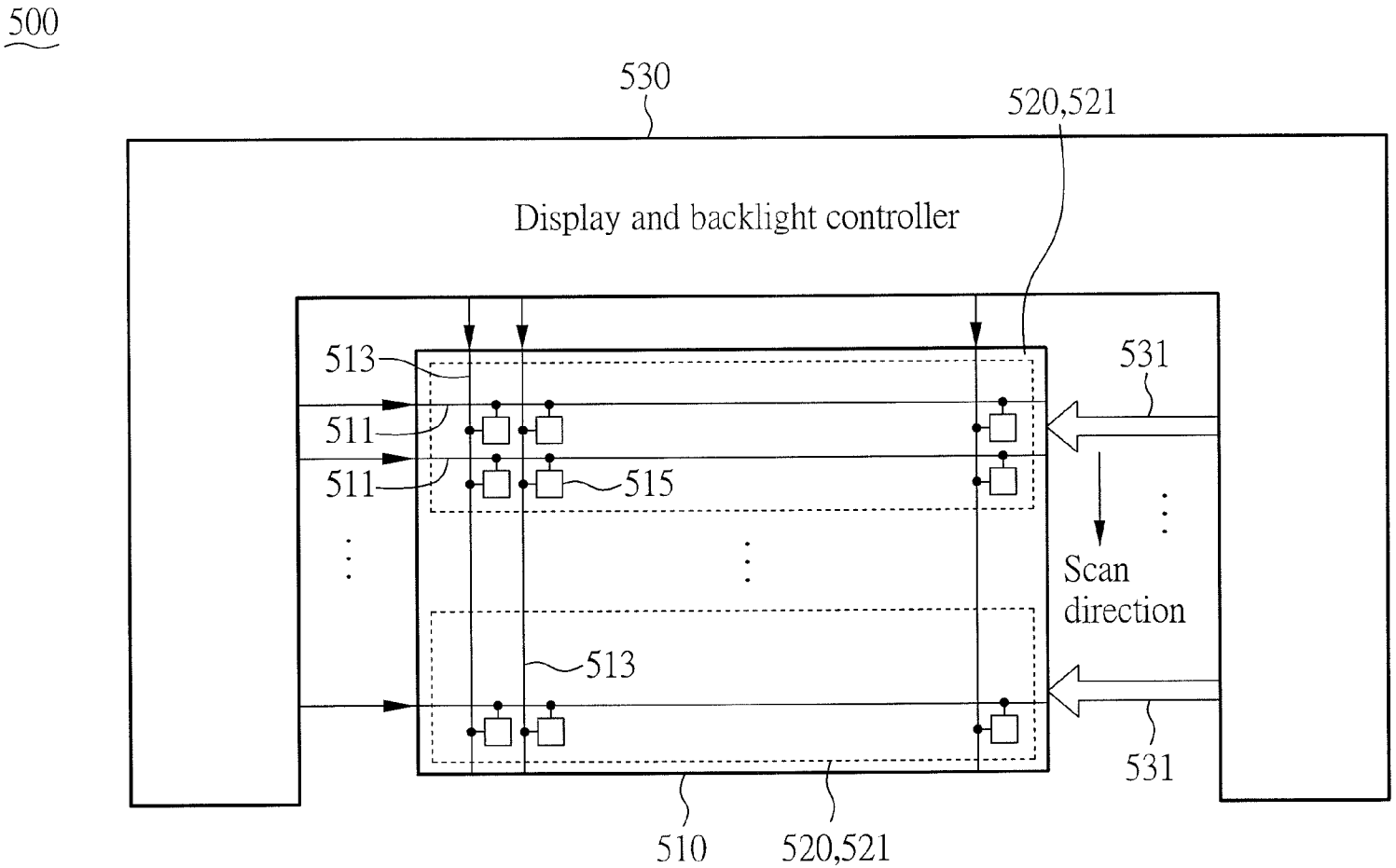
FIG. 10 is a block diagram of a display system in accordance with another embodiment of the present disclosure.

FIG. 10 is a block diagram of a display system 500 in accordance with another embodiment of the present disclosure. In FIG. 11, the backlight module 520 is divided into a plurality of sub-backlight modules 521, which can be separately driven along the scan direction by the display and backlight controller 530.

As cited, the present disclosure uses the backlight driver 840 to increase the backlight drive signal to compensate the loss of the brightness owing to TFT cut-off current leakage in the second half of the suspend period, so that the flickering phenomenon can be effectively eliminated by the backlight compensation. In addition, in the charge period, the backlight driver 840 decreases the backlight drive signal so as to lower the brightness. Thus, the brightness in the charge period will be more consistent with the brightness in the suspend period.

Although the present disclosure has been explained in relation to its various embodiments, it is to be understood that many other possible modifications and variations can be made without departing from the spirit and scope of the invention as hereinafter claimed.

What is claimed is:

1. A display system, comprising:

a display panel including a plurality of scan lines, a plurality of source lines intersecting the scan lines, and a plurality of pixels arranged at intersections of the scan lines and the source lines;

a backlight module coupled to the display panel for projecting light to the pixels of the display panel, the light having a backlight brightness; and a display and backlight controller receiving an input image data and connected to the display panel and the backlight module for providing a low frequency driving mode, wherein, in the low frequency driving mode, a display interval in one frame is divided into a charge period and a suspend period, and the backlight brightness is changed in the suspend period; and wherein a frame time of the low frequency driving mode is between 0.5 and 2 seconds.

2. The display system as claimed in claim 1, wherein the backlight brightness starts to be changed at a first specific time in a second half of the suspend period.

3. The display system as claimed in claim 2, wherein the backlight brightness finishes to be changed at a second specific time in a first half of a charge period in a successive frame.

4. The display system as claimed in claim 1, wherein the period of the backlight brightness being changed is equal to or longer than a half of the charge period and is equal to or shorter than a half of the suspend period.

5. The display system as claimed in claim 1, wherein the backlight brightness is changed from a first brightness to a second brightness.

6. The display system as claimed in claim 5, wherein the second brightness is greater than the first brightness.

7. The display system as claimed in claim 5, wherein the second brightness is smaller than the first brightness.

8. The display system as claimed in claim 5, wherein a backlight change ratio defined by a ratio of the first brightness to the second brightness is between 0.8 and 1.2.

9. The display system as claimed in claim 1, wherein the backlight brightness is changed at least two times in the suspend period of the display interval in one frame.

10. The display system as claimed in claim 9, wherein the backlight brightness is changed from a first brightness to a second brightness in a first period, and the backlight brightness is changed from the second brightness to a third brightness in a second period.

11. The display system as claimed in claim 10, wherein the summation of first period and the second period is equal to or longer than a half of the charge period and is equal to or shorter than a half of the suspend period.

12. The display system as claimed in claim 1, wherein the backlight brightness is changed to a specific value according to a predominant gray level of the input image data.

13. The display system as claimed in claim 1, wherein the display and backlight controller provides either the low frequency driving mode or a normal driving mode.

14. The display system as claimed in claim 13, wherein the backlight controller provides the low frequency driving mode if the input image data is determined as a still image or provides the normal driving mode if the input image data is determined as a moving image.

15. The display system as claimed in claim 13, wherein the display interval in one frame in the low frequency driving mode is longer than that in the normal driving mode.

* * * * *